US009242347B2

(12) United States Patent
Krause et al.

(10) Patent No.: US 9,242,347 B2
(45) Date of Patent: Jan. 26, 2016

(54) QUICK RELEASE CONNECTOR

(75) Inventors: Aaron C. Krause, Voorhees, NJ (US); Aleksandrs Titovs, Olaine (LV)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 426 days.

(21) Appl. No.: 13/319,705

(22) PCT Filed: May 13, 2010

(86) PCT No.: PCT/US2010/034626
§ 371 (c)(1), (2), (4) Date: Nov. 10, 2011

(87) PCT Pub. No.: WO2010/132620
PCT Pub. Date: Nov. 18, 2010

(65) Prior Publication Data

US 2012/0051832 A1 Mar. 1, 2012

Related U.S. Application Data

(60) Provisional application No. 61/177,909, filed on May 13, 2009.

(51) Int. Cl.

| | |
|---|---|
| ***F16B 21/00*** | (2006.01) |
| ***B24D 13/20*** | (2006.01) |
| ***B24B 45/00*** | (2006.01) |

(52) U.S. Cl.
CPC ..... *B24D 13/20* (2013.01); *B24B 45/006* (2013.01); *Y10T 403/20* (2015.01); *Y10T 403/56* (2015.01); *Y10T 403/59* (2015.01); *Y10T 403/70* (2015.01); *Y10T 403/7075* (2015.01)

(58) Field of Classification Search
CPC ..... B25G 3/18; F16B 21/00; F16B 1/00
USPC ..... 403/322.1, 322.2, 348, 349; 411/348
See application file for complete search history.

(56) References Cited

U.S. PATENT DOCUMENTS

| | | | |
|---|---|---|---|
| 2,100,340 | A | 11/1937 | Lippitt |
| 2,671,994 | A | 3/1954 | Hickman |
| 3,990,124 | A | 11/1976 | MacKay, Jr. |

(Continued)

FOREIGN PATENT DOCUMENTS

| | | |
|---|---|---|
| RU | 2289501 | 12/2006 |
| WO | WO 96/23627 | 8/1996 |

OTHER PUBLICATIONS

PCT International Search Report for PCT/US2010/034626, mailed Aug. 11, 2010.

(Continued)

*Primary Examiner* — Daniel Wiley
(74) *Attorney, Agent, or Firm* — Aleksander Medved

(57) ABSTRACT

A quick release connector for a power tool accessory having a center aperture. The connector comprises a body having a first end adapted to be attached to a shaft of a power tool and a second end that includes a connector head that is adapted to be moved axially into and to fit within the center aperture of the accessory for transferring motion from the power tool to the accessory. In one embodiment, the connector includes an indicator for providing a positive indication to a user that the connector head is properly secured to the accessory and, in another embodiment, the connector includes an ejector for pushing the accessory off of said connector head.

8 Claims, 4 Drawing Sheets

(56) References Cited

U.S. PATENT DOCUMENTS

| | | | | |
|---|---|---|---|---|
| 4,607,412 | A | 8/1986 | Ashworth | |
| 4,657,428 | A * | 4/1987 | Wiley | 403/359.3 |
| 4,796,321 | A | 1/1989 | Lee | |
| 5,088,241 | A | 2/1992 | Lubbering | |
| 5,289,745 | A | 3/1994 | Beardsley | |
| 5,461,750 | A | 10/1995 | Kaiser | |
| D367,743 | S | 3/1996 | Krause | |
| 6,349,446 | B1 | 2/2002 | Krause | |
| 6,626,067 | B1 | 9/2003 | Iwinski | |
| 6,640,377 | B2 | 11/2003 | Krause | |
| 6,895,631 | B1 | 5/2005 | Krause | |
| 6,939,213 | B2 * | 9/2005 | Lovchik et al. | 451/360 |
| 7,052,022 | B2 * | 5/2006 | Chudy et al. | 279/143 |
| 7,716,778 | B2 | 5/2010 | Meister | |
| 8,302,255 | B2 | 11/2012 | Lin | |
| 2004/0126182 | A1 * | 7/2004 | Lin | 403/322.2 |
| 2007/0010184 | A1 | 1/2007 | Stein | |
| 2007/0184763 | A1 | 8/2007 | Chung | |
| 2007/0266514 | A1 | 11/2007 | Umbrell | |
| 2008/0254725 | A1 | 10/2008 | Henning | |

OTHER PUBLICATIONS

The 2000 Edge, "The Edge 2000® Premium Buffing System—Foam," brochure.

The 2000 Edge Premium Buffing System, "go ahead . . . push my Button," brochure.

* cited by examiner

QUICK RELEASE CONNECTOR

CROSS REFERENCE TO RELATED APPLICATIONS

This application is a national stage filing under 35 U.S.C. 371 of PCT/US2010/034626, filed May 13, 2010, which claims priority to U.S. Application No. 61/177,909, filed May 13, 2009, the disclosure of which is incorporated by reference in its/their entirety herein.

BACKGROUND

The present invention is directed to a quick release connector for an accessory adapted for use with a power tool and, more particularly, to a quick release connector for an accessory such as a buffing pad adapted for use with a power buffer. The quick release connector allows, in one embodiment, for a two-sided buffing pad to be quickly released from a power buffer, reversed, and reattached to the power buffer.

Buffing pads for use in high speed polishing of automobiles and the like may be one-sided or two-sided. A one-sided buffing pad is typically circular and comprises a buffing medium (e.g., foam, wool, etc.) attached to one face of a rigid backing plate which is attached by a central hub to the drive shaft or spindle of a motor for a power buffer. The buffing medium may be permanently attached to the backing plate or releasably attached thereto in order to allow for replacement without disposing of the backing plate. A two-sided buffing pad includes buffing medium attached to each face of a rigid backing plate. The plate includes a hub for releasably attaching the buffing pad to the drive shaft or spindle of the buffing motor. The pad may be attached to the drive shaft or spindle of the motor from either side of the buffing pad, thereby allowing the pad to be reversed after one side has been used.

U.S. Pat. No. 4,607,412 to Ashworth discloses a reversible buffing pad that includes a hub that can be releasably attached to a drive shaft from either side of the hub. A center disk is attached to the hub and a pair of buffing pads is provided.

U.S. Pat. No. 5,461,750 to Kaiser discloses a backing plate for a rotary buffing pad assembly that provides cushioned support for a pair of curved edge buffing pads mounted back-to-back.

U.S. Pat. No. 6,640,377 to Krause et al. discloses a quick release buffing pad assembly. A buffing pad assembly having a right pad, a left pad, a disk securing the two pads together, and an elongated member for releasably attaching the buffing pad to the drive shaft of a buffing motor is disclosed. Each pad has a central aperture. The disk has a connector located in the center thereof with an opening therethrough. The right and left pads are secured to first and second faces, respectively, of the disk so that the apertures and opening are aligned when the buffing pad is assembled. The elongated member has a body, a head, and an indented area separating the head and the body. The head fits through either of the apertures and through the opening of the connector. The elongated member also has an open end which may be secured to the spindle of a buffing motor. Contained within the indented area is an O-ring which releasably secures the elongated member within the opening yet allows for the pad to be easily snapped off of the elongated member so that either side of the buffing pad may be used.

In another iteration of the quick release buffing pad assembly just described, the O-ring was replaced with spring biased balls that cooperate with complementary recesses in an opening in the disk so that the buffing pad can be easily and quickly attached to and removed from the drive shaft or spindle of a buffing motor to which the connector is secured.

SUMMARY OF THE INVENTION

In a first embodiment the invention relates to a quick release connector for a power tool accessory (such as a buffing pad intended for use with a rotary power tool such as a power buffer) having a center aperture. The connector comprises a body having a first end that is adapted to be attached to a shaft of a power tool (for example, by an internal thread that is adapted to be threaded onto the shaft), and a second end that includes a connector head that is adapted to be moved axially into and to fit within the center aperture of the accessory for transferring motion from the power tool to the accessory. A locking member is carried by the connector head to prevent the connector head from being inadvertently removed from the accessory. The connector also includes an indicator for providing a positive indication to a user that the connector head is properly secured to the accessory, for example an audible indication such as a clicking sound. The center aperture in the accessory and the connector head can have any non-circular shape but it is preferred that they be hexagonal.

In a second embodiment the invention relates to a quick release connector for a power tool accessory (such as a buffing pad intended for use with a rotary power tool such as a power buffer) having a center aperture, wherein the connector comprises a body having a first end and a second end substantially as described above. The connector includes an ejector for pushing the accessory off of the connector head. The connector may be provided with a manually-operated actuator that is carried by the connector body for activating the ejector. Activation of the ejector may emit an audible sound such as a click to confirm that it has been activated. The center aperture in the accessory and the connector head can have any non-circular shape but it is preferred that they be hexagonal.

The first embodiment of the invention may also include an ejector for pushing the accessory off of the connector head. The second embodiment of the invention may also include a locking member carried by the connector head to prevent the connector head from being inadvertently removed from the accessory and an indicator for providing a positive indication to a user that the connector head is properly secured to the accessory such as a clicking sound.

In a third embodiment the invention relates to a quick release connector for a rotary power tool accessory (such as a buffing pad), the accessory having a hub with a noncircular center aperture, the aperture having at least one radially extending recess (preferably, a plurality of recesses) therein. The connector comprises a substantially tubularly shaped body having a first end with an internal thread that is adapted to be threaded onto a shaft of a rotary power tool, and a second end that includes a connector member having a noncircular head that is adapted to fit within the noncircular center aperture of the accessory hub for transferring rotary motion from the power tool to the accessory.

A radial opening is formed in the head and at least one ball (preferably, a plurality of balls) is within head and adjacent to the opening. The ball is moveable between an unlocked position wherein it does not extend beyond the outer surface of the head and a locked position wherein it extends partially through the opening and is adapted to engage the radially extending recess in the hub aperture.

A mandrel is located within the body and is axially moveable relatively thereto between a forward position wherein it engages the ball and moves the ball into its locked position, and a rear position wherein it does not engage the ball and the ball is free to move into its unlocked position. A spring biases the mandrel into the forward position.

An outer sleeve surrounds the body and is fixed to the mandrel for movement with the mandrel. A collar is secured to the outer sleeve and is adapted to be grasped by a person's fingers and moved rearwardly thereby moving the mandrel rearwardly relative to the body to allow the ball to move into its unlocked position, and allowing the head to be removed from the accessory.

The quick release connector may further including an inner sleeve around the body but within the outer sleeve, with the inner sleeve being adapted to move forward to engage the accessory and dislodge it from the head when the outer sleeve is moved rearwardly.

The quick release connector may further including an additional spring biasing the inner sleeve forwardly and further including detent means for temporarily holding the inner sleeve in a rear position. Rearward movement of the collar releases the detent means allowing the inner collar to move forwardly by the additional spring. When the head is inserted into the aperture, the inner sleeve is moved rearwardly by the accessory causing the detent means to engage which may emit a clicking sound.

BRIEF DESCRIPTION OF THE DRAWINGS

For the purpose of illustrating the invention, there is shown in the accompanying drawings one form which is presently preferred, it being understood that the invention is not intended to be limited to the precise arrangements and instrumentalities shown.

DETAILED DESCRIPTION

Figure 1:
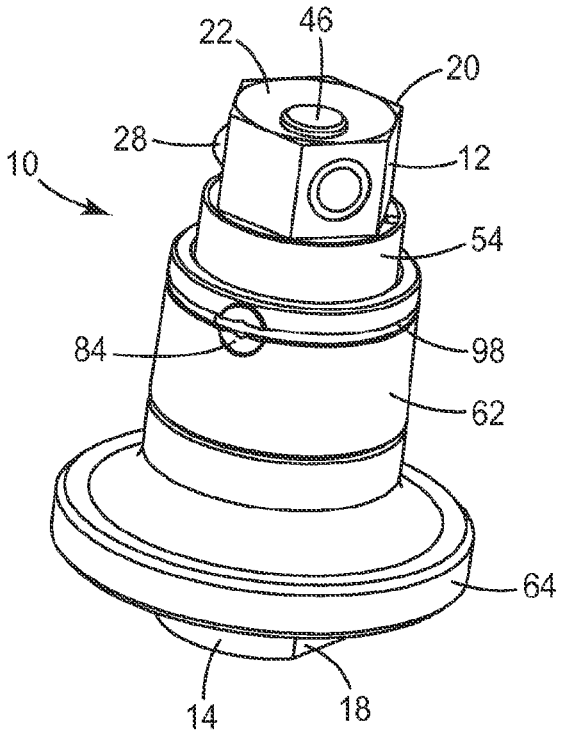
FIG. 1 is a top perspective view of one embodiment of a quick release connector according to the invention.
Figure 2:
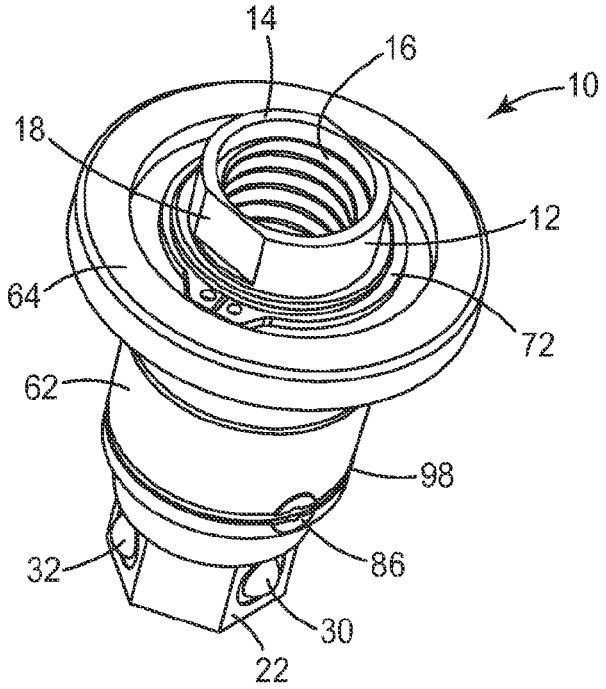
FIG. 2 is a bottom perspective view thereof.
Figure 3:
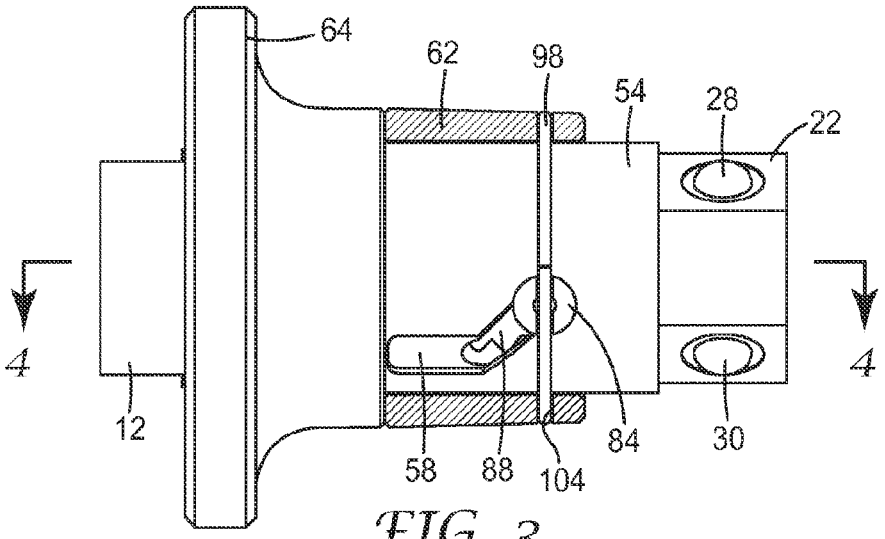
FIG. 3 is a side elevational view thereof.

Referring now to the accompanying drawings in detail wherein like reference numerals have been used throughout the various figures to designate like elements, there is shown in FIGS. 1 and 2 a preferred embodiment of a quick release connector designated generally as 10. Quick release connectors according to the invention are particularly useful in conjunction with accessories for power tools (i.e., tools having a motor-driven shaft), for example a buffing pad used with a power buffer. While a desired use of the invention is with rotary power tools (i.e., power tools that rotate an accessory around a central axis), other power tools such as those employing orbital or oscillatory motion can benefit from quick connectors according to the invention. Similarly, although the invention is particularly discussed in the context of power buffers, many other power tools such as a polishing machine, a grinding wheel, a cutting wheel, a sanding wheel, a drill or the like may enjoy the advantages of the invention.

There is a need for a connector that allows a reversible buffing pad to be quickly and easily attached to and released from the drive shaft or spindle of a buffing motor. Sometimes it can be difficult to determine whether a buffing pad has been properly positioned on a connector and improper positioning can result in the buffing pad becoming dislodged during use which may damage the surface being buffed. There have also been difficulties at times when removing a buffing pad from a connector. Thus, there is also a need for a connector that indicates when a pad has been properly attached to and positioned on a connector and which also positively releases or ejects the pad from the connector.

The quick release connector 10 is comprised of a substantially tubularly shaped body 12 (see FIG. 7) having a first end 14 with an internal thread 16. The internal thread 16 permits the connector body 12 to be threaded onto (or otherwise attached to) the shaft or spindle of a motor used with a power tool such as a power buffer in a manner well known to those skilled in the field. The first end 14 may also include flat areas such as shown at 18 at the outer surface thereof so that the same can be held by a wrench or pliers or the like for aiding in securing the connector to the shaft.

A second end 20 of the connector 10 includes a connector member comprised of a hexagonal head 22 which is adapted to be moved axially into and fit within a corresponding hexagonal aperture formed in the center of the hub of the accessory that is to be mounted on the motor-driven shaft of the power tool, such as a buffing pad for attachment to a power buffer. A portion of a central opening 24 of a hub 26 is shown, for example, in FIGS. 5 and 6. For clarity, only the hub 26 is shown. In the case of a two-sided buffing pad, by way of example, the hub 26 will be covered with foam, wool or other suitable buffing medium on both faces as shown in U.S. Pat. No. 6,640,377, which patent is incorporated herein by reference.

The hexagonal shape of the head 22 and the aperture 24 is preferred but this is by way of example only. The head 22 and the aperture 24 could have a triangular or square or octagonal cross section. In fact, substantially any noncircular cross section of the head 22 and the aperture 24 could be used provided that the head can fit within the center aperture of the accessory hub to allow the motion of the power tool to be transferred to the accessory.

Located within the head 22 are three balls 28, 30 and 32 preferably formed of steel or other metal. The head 22 includes three corresponding radial openings 34, 36 and 38 equally spaced around the head in the centers of the flat surfaces forming the hexagonal shape of the head. The openings 34, 36 and 38 each have a diameter which is slightly less than the diameter of the balls 28, 30 and 32. Thus, a significant portion of each ball can extend through its respective opening but cannot pass entirely therethrough.

Also located within the body 12 is a mandrel 40. The forward end of the mandrel 40 includes stepped, reduced diameter cylindrical sections 42 and 44. Sections 42 and 44 are located within the hexagonal head 22 as shown most clearly in FIG. 4. The mandrel 40 is axially movable within a relatively narrow range within the center of the tubular body 12.

Figure 4:
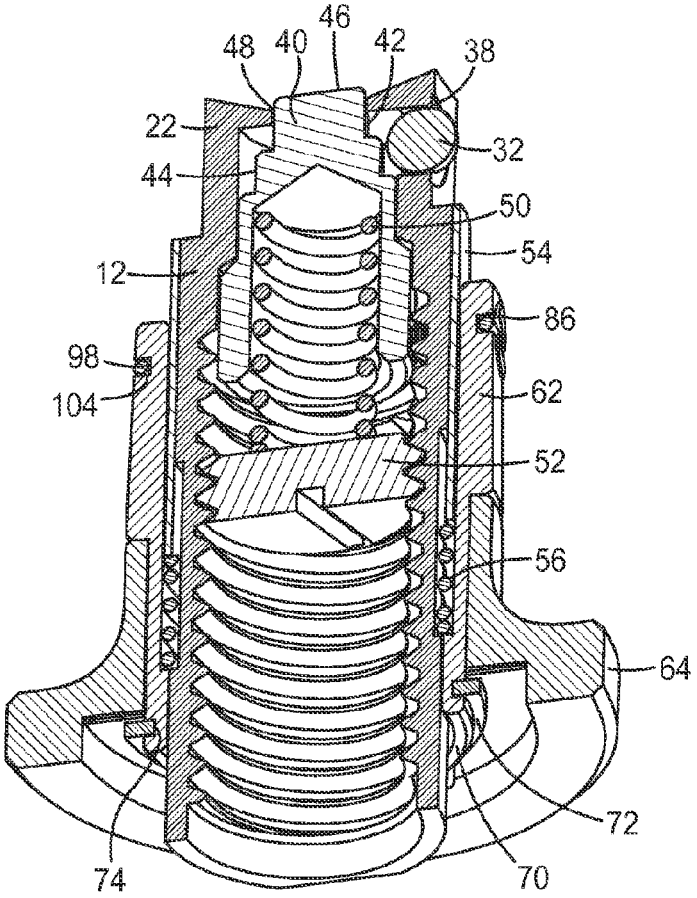
FIG. 4 is a cross-sectional view taken along line 4-4 of FIG. 3.

As best seen in FIG. 4, when the mandrel 40 is in its forwardmost position, the larger diameter cylindrical section 44 forces the ball 32 outwardly so as to project through the opening 38 in the head 22. In this position, distal end 46 of the mandrel 40 can extend slightly through opening 48 at the end of the head 22. In this forward position, the mandrel engages the balls and moves them into their operative, engaged or locked position as shown in FIG. 4 which locks the head 22 into the center aperture 24 of the hub 26 of the buffing pad. The locking effect is due to the fact that the inner surface of the aperture 24 includes a plurality of radially extending recesses, one of which is shown at 50 in FIG. 6, which are complementary to the shape of the balls 28, 30 and 32. Thus, balls 28, 30 and 32 and the corresponding recesses 50 function as a locking member under the action of the mandrel 40.

When the mandrel 40 is moved axially rearwardly, the smaller diameter cylindrical section 42 at the end thereof moves into position adjacent the balls 28, 30 and 32 allowing the balls to move inwardly into an inoperative, disengaged or unlocked position. This allows the head 22 of the body 12 to be removed from the buffing pad.

A spring 50 located within the hollow center of the mandrel 40 is used to bias the mandrel forwardly into the locking position as shown in FIG. 4. The spring 50 is held in place by a nut 52 that is screwed into the internal thread 16 of the body 12 as best shown in FIG. 4. The tension on the spring 50 can be adjusted by the use of the nut 52. This is accomplished by inserting a flat head screwdriver through the open rear end of the body 12.

An inner cylindrical sleeve 54 surrounds the mid-portion of the body 12 and is biased forwardly by the action of spring 56. A pair of dog legged shaped slots 58 and 60 on opposite sides of the inner sleeve 54 and passing through the wall thereof guide and limit the axial movement of the sleeve 54 in a manner to be described more fully below.

Surrounding a substantial portion of the inner sleeve 54 and the spring 56 is an outer sleeve 62. The outer sleeve 62 has a collar 64 secured to the rear end thereof. This can be accomplished by molding or machining the collar 64 and sleeve 62 as a single piece or the collar can be assembled onto the sleeve 62 in the manner shown. More particularly, the opening 66 in the center of the collar 64 is placed over the rear end 68 of the outer sleeve 62 until an end 70 is exposed at the other side of the collar 64 as shown most clearly in FIG. 4. At that point, the collar 64 is locked in place on the sleeve 62 through the use of a spring clamp 72 that fits into a groove 74 at the end of the sleeve 62. To ensure that the parts are fitted together tightly, one or more washers 76 and 78 may be inserted between the spring clamp 72 and the collar 64 as shown most clearly in FIGS. 4 and 7.

The forward end of the outer sleeve 62 includes two opposed openings 80 and 82 in the side wall thereof. Openings 80 and 82 allow the threaded portions of machine screws 84 and 86 to pass therethrough. When connector 10 is assembled, the openings 80 and 82 in the outer sleeve 62 align with a portion of the dog legged shaped slots 58 and 60 on the inner sleeve 54. The body 12 also has slots formed through the side wall thereof that align with the openings 80 and 82 and the slots 58 and 60. Only one such slot 88 in the body 12 can be seen in the figures. It should be understood, however, that an identical slot is formed on the other side 180° from the slot 88. As can be seen, the slot 88 includes a diagonally extending portion 90 and an axially extending portion 92. The intersection of these two portions results in a recessed or detent semi-circular section 94 as shown best in FIG. 7.

Figure 7:
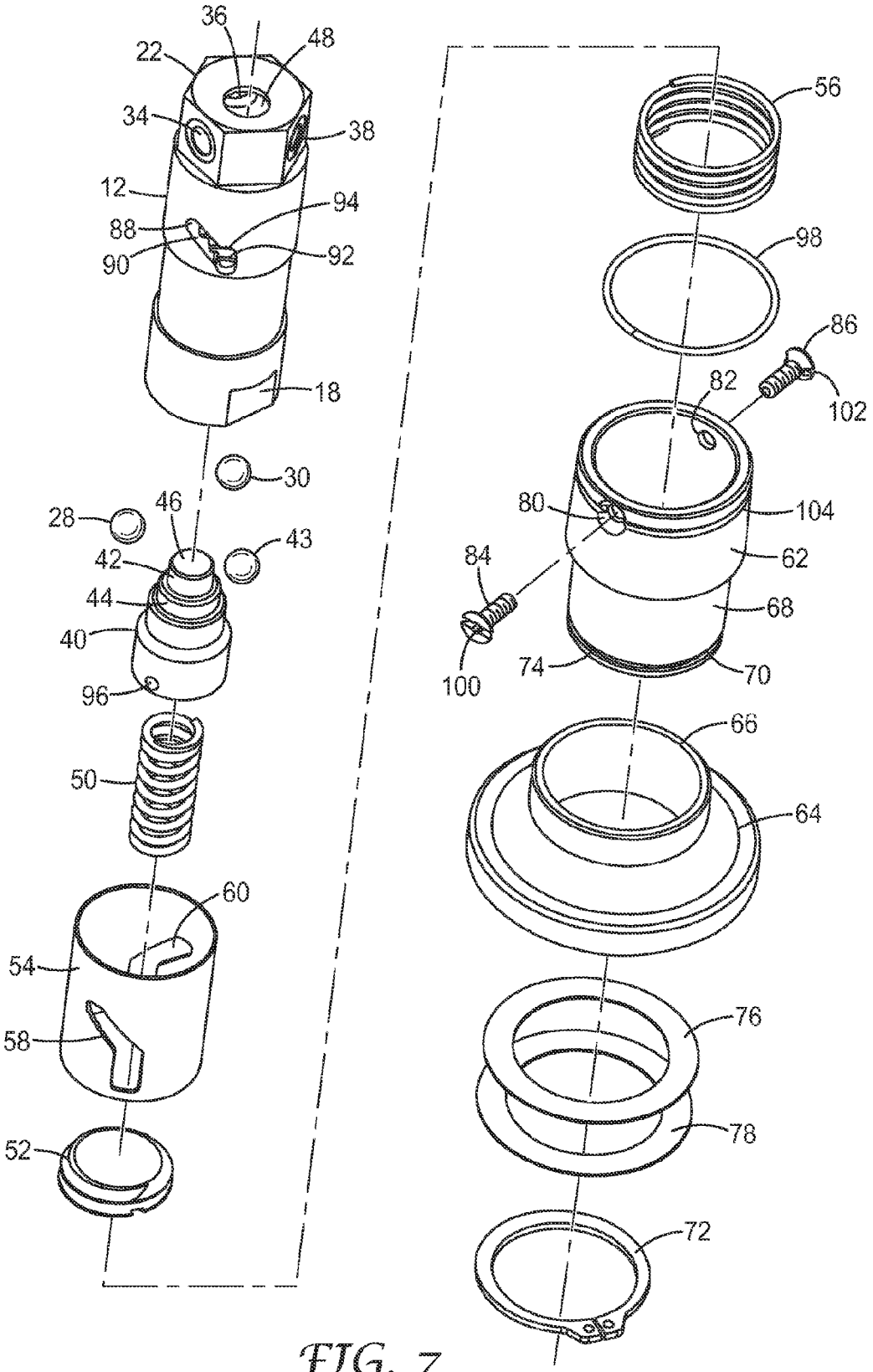
FIG. 7 is an exploded perspective view of the quick release connector.

The screws 84 and 86 pass through the openings 80 and 82, the slots 58 and 60, and the slots 88 in the body 12. They are then threaded into threaded openings in the mandrel 40. Only one such opening 96 is shown in FIG. 7. It should be readily apparent, however, that a similar threaded opening is located on the opposite side of the mandrel 40 180° from the threaded opening 96. The screws 84 and 86 are maintained in place and are prevented from unscrewing by a spring ring 98 that fits around the screws and rests in the slots 100 and 102 in the screw heads and in circumferential slot 104 in the forward end of the outer sleeve 62.

The quick release connector 10 of the present invention is utilized in the following manner with a buffing pad. In order to attach the head 22 to the buffing pad the connector is in the position shown in FIG. 6. In this position the inner sleeve 54 is in its forwardmost position, the mandrel 40 is in a rear position, and the balls 28, 30 and 32 are in their inoperative (i.e. disengaged and unlocked) position. The screws 84 and 86 are, at this point, resting in the detents or notches 94. As the connector 10 is moved toward the buffing pad (or the buffing pad is moved toward the connector), the head 22 enters the aperture 24 of the buffing pad and the forwardmost end of the inner sleeve 54 engages the hub 26.

Further movement causes the inner sleeve 54 to move axially rearwardly. As further rearward movement occurs, the screws 84 and 86 engage the angled portions of the slots 58 and 60 on the sleeve 54 which causes the screws and the mandrel 40 to rotate slightly out of the detent 94. As this occurs, the spring 50 forces the mandrel 40 forwardly as the screws 84 and 86 enter the angled portions 90 of the slots 88 in the body 12. This action causes the mandrel 40 to snap forwardly creating a distinct, positive and audible indication in the form of a clicking or snapping sound. When the mandrel snaps forwardly, the larger diameter portion 44 of the forward end thereof engages the balls 28, 30 and 32 to force them into their operative (i.e. engaged and locked) position. The buffing pad is thus locked securely onto the head 22 of the connector 10 and the audible click or snapping sound provides positive confirmation of the same to a user.

Rearward movement of the inner sleeve 54 and forward movement of the mandrel 40 to force the balls 28, 30 and 32 into their locked position also sets the connector so that it can facilitate disengaging the head 22 from the buffing pad in order to remove the same as explained more fully below.

Figure 5:
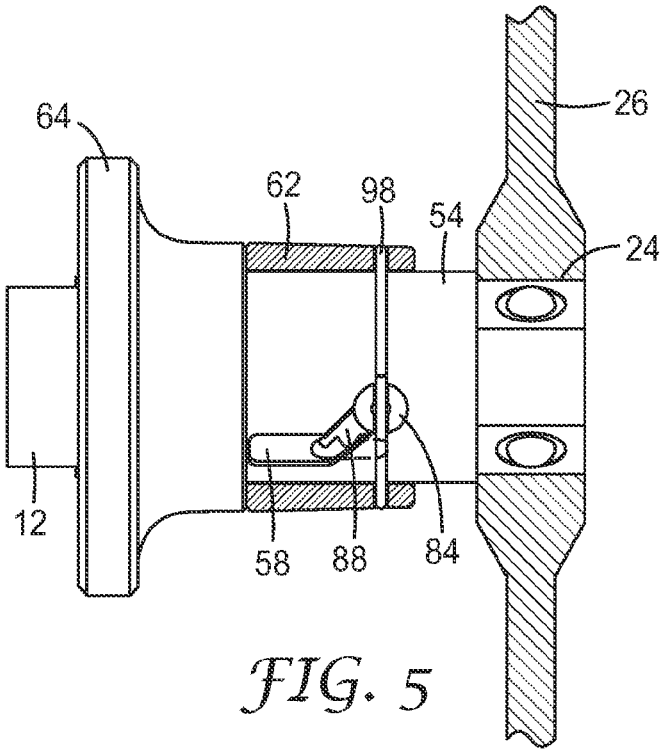
FIG. 5 is a side elevational view showing the connector connected to a backing plate of an exemplary buffing pad.
Figure 6:
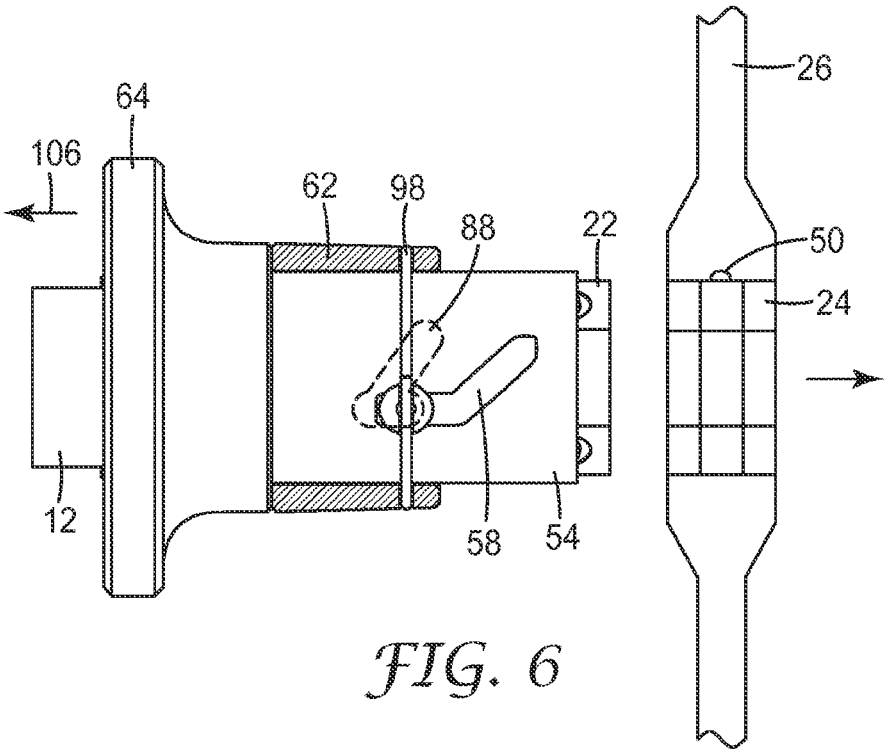
FIG. 6 is a side elevational view similar to FIG. 5 but showing the backing plate released from the connector.

To disengage the head 22 from the buffing pad, the collar 64 is grasped utilizing a person's fingers and moved rearwardly or to the left as shown in FIGS. 5 and 6 (see arrow 106 in FIG. 6). As this occurs, the screws 84 and 86 also pull the mandrel 40 rearwardly thereby allowing the balls 28, 30 and 32 to move into their inoperative position. At this time, the inner sleeve 54 which is biased forwardly by the spring 56 pushes the buffing pad to the right positively disengaging the buffing pad from the head 22 of the connector 10. Thus inner sleeve 54 functions as an ejector to facilitate removing the buffing pad from the head 22 of the connector 10 by pushing the buffing pad off of the head. Collar 64 is a readily manipulated, manually-operated actuator carried by body 12 for activating the ejector.

Securing the buffing pad or other accessory to the connector as described herein enables inner sleeve 54 to function as an ejector so as to push the buffing pad off of the head 22 when collar 64 is moved rearwardly. This action also generates a positive and audible indication in the form of a clicking or snapping sound.

The present invention may be embodied in other specific forms without departing from the spirit or essential attributes thereof and accordingly, reference should be made to the appended claims rather than to the foregoing specification as indicating the scope of the invention.

What is claimed is:

1. A quick release connector for a rotary power tool accessory, said accessory having a hub with a noncircular center aperture, said aperture having at least one radially extending recess therein, said connector comprising:

a substantially tubularly shaped body having a first end with an internal thread adapted to be threaded onto a shaft of a rotary power tool and a second end;

said second end including a connector member having a noncircular head adapted to fit within said noncircular center aperture of said accessory hub for transferring rotary motion from said power tool to said accessory;

a radial opening in said head and at least one ball within said head adjacent said opening;

said ball being moveable between an unlocked position wherein it does not extend beyond the outer surface of said head and a locked position wherein it extends partially through said opening and is adapted to engage said radially extending recess in said hub aperture;

a mandrel located within said body and axially moveable relatively thereto between a forward position wherein it engages said ball and moves said ball into its locked position and a rear position wherein it does not engage said ball and said ball is free to move into its unlocked position;

a spring biasing said mandrel into said forward position;

an outer sleeve surrounding said body, said outer sleeve being fixed to said mandrel for movement therewith;

a collar secured to said outer sleeve, said collar being adapted to be grasped by a person's fingers and moved rearwardly thereby moving said mandrel rearwardly relative to said body to allow said ball to move into its unlocked position so as to allow said head to be removed from said accessory; and an inner sleeve around said body but within said outer sleeve, and an additional spring biasing said inner sleeve forwardly, said inner sleeve comprising a slot to guide axial movement of the inner sleeve with respect to the outer sleeve, the inner sleeve being adapted to move forward to engage said accessory to dislodge it from said head when said outer sleeve is moved rearwardly;

wherein the outer sleeve is fixed to said mandrel by at least one connecting member extending through the slot in the inner sleeve.

2. The quick release connector for a rotary power tool accessory as claimed in claim 1 further including detent means for temporarily holding said inner sleeve in a rear position.

3. The quick release connector for a rotary power tool accessory as claimed in claim 2 wherein rearward movement of said collar releases said detent means allowing said inner sleeve to move forwardly by said additional spring.

4. The quick release connector for a rotary power tool accessory as claimed in claim 2 wherein said inner sleeve is movable rearwardly with respect to said head to cause said detent means to engage.

5. The quick release connector for a rotary power tool accessory as claimed in claim 1 wherein said head is hexagonal.

6. The quick release connector for a rotary power tool accessory as claimed in claim 1 including a plurality of balls within said head.

7. The quick release connector for a rotary power tool accessory as claimed in claim 1 wherein the at least one connecting member comprises a screw.

8. The quick release connector for a rotary power tool accessory as claimed in claim 7 further comprising a spring ring that maintains the screw in place and prevents the screw from unscrewing.

* * * * *